US005829992A

United States Patent [19]

Merker et al.

[11] Patent Number: 5,829,992

[45] Date of Patent: Nov. 3, 1998

[54] DEVICE AND METHOD FOR GROUNDING/ BONDING CABLE TELEVISION CONNECTORS

[76] Inventors: Joseph J. Merker, 1235 Chew St.; Doug E. Eck, 33 S. Madison St., both of Allentown, Pa. 18102

[21] Appl. No.: 807,508

[22] Filed: Feb. 27, 1997

Related U.S. Application Data

[60] Provisional application No. 60/013,090, Mar. 8, 1996.

[51] Int. Cl.[6] ..... H01R 4/66

[52] U.S. Cl. ..... 439/98; 439/101; 439/797

[58] Field of Search ..... 174/78, 79; 439/98, 439/100, 101, 105, 108, 797, 798, 810; 29/842, 857

[56] References Cited

U.S. PATENT DOCUMENTS

| | | |
|---|---|---|
| 1,590,590 | 6/1926 | Seymour et al. . |
| 3,967,872 | 7/1976 | Mooney et al. . |
| 4,189,198 | 2/1980 | Reichman . |
| 4,248,490 | 2/1981 | Bachle . |
| 4,257,658 | 3/1981 | Hammond et al. . |
| 4,739,126 | 4/1988 | Gutter et al. . |
| 4,806,108 | 2/1989 | Meinhardt . |
| 4,875,864 | 10/1989 | Campbell . |
| 5,286,211 | 2/1994 | McIntosh . |
| 5,315,063 | 5/1994 | Auclair . |
| 5,364,281 | 11/1994 | Leto . |
| 5,418,330 | 5/1995 | Rook . |

FOREIGN PATENT DOCUMENTS

| | | |
|---|---|---|
| 968431 | 5/1975 | Canada . |
| 2224893 | 5/1990 | United Kingdom . |
| 2232020 | 11/1990 | United Kingdom . |

*Primary Examiner*—Khiem Nguyen
*Attorney, Agent, or Firm*—Richard C. Litman

[57] ABSTRACT

A device and method for grounding/bonding a cable television connector. A planar block of conductive material having various configurations connects the connector parallel to a ground/bond wire. The block has a set of two to four throughbores in it. The first throughbore receives the cable television connector, the second throughbore receives a ground/bond wire or a ground/bond bolt, the third throughbore receives a set screw for the ground/bond wire, and the fourth throughbore if required receives a set screw for the cable television connector. The block can have a plurality of the three throughbore sets for grounding/bonding a plurality of cable television connectors. The cable television connectors generally have threads that mate with the threads of the first throughbore. One embodiment integrates the block and the cable television connector resulting in only two throughbores for a set screw to secure a ground/bond wire which is perpendicular to the axis of the connector.

20 Claims, 8 Drawing Sheets

DEVICE AND METHOD FOR GROUNDING /BONDING CABLE TELEVISION CONNECTORS

CROSS-REFERENCE TO RELATED APPLICATION

This application claims the benefit of U.S. Provisional patent application Ser. No. 60/013,090, filed Mar. 8, 1996.

BACKGROUND OF THE INVENTION

1. Field of the Invention

The present invention relates to grounding/bonding devices for cable television. Specifically, the invention relates to a device for grounding/bonding cable television connectors that requires no extra jumper cables and couplers. The present invention also relates to a method of accomplishing the same.

2. Description of the Prior Art

Numerous attempts have been made for the provision of grounding and bonding connections for electrical systems subject to electrical surges, e.g., a lightning strike. However, there have been few attempts made, if any, for specifically protecting the signal carrying conductors of television cables. During electrical rainstorms, many cable television subscribers lose their cable connections, leaving them without a suitable cable television signal to receive emergency information from the cable television networks. Thus, there is a need for an improved ground/bond connection for television cable which is effective, yet inexpensive.

For example, as seen in the prior art apparatus depicted in FIG. 7, the signal carrying cable 20A terminates in a bulk cable end 20. This bulk cable end 20 is integrated with a first threaded section 22 and a second threaded section 24. The first threaded section 22 is used for seating the bulk cable end 20 in a mounting grid or the like. The second threaded section 24 is conventionally a female F type RF connector and mates with a first male F type connector 42. The first male connector 42 joins a segment of jumper wire 40, generally a standard RG type coaxial cable, which then terminates in a second male F type connector 44. The second male F type connector 44 couples to a female to female F type connection block 46. A barrel connector (not shown) is inside the connector block 46 to couple with the connectors 26 and 44. This connection block 46 provides the typical ground/bond connection by a ground wire 30 clamped to the block 46 by a set screw 48. Opposite the male connector 44 on the block 46 is a third male F type connector 26 which is the lead termination for the RG type coaxial cable 28 carrying the RF signal to a decoder or the like for eventual display for a cable television monitor. The jumper wire 40 and the connection block 46 adds expense and complexity to an impedance dependent electrical system, thus making it very difficult to install and maintain.

Other examples of grounding connections are found in the following prior art. U.S. Pat. No. 1,590,590, issued Jun. 29, 1926, to Seymour et al., discloses a combined water system service protector and electrical ground. U.S. Pat. Nos. 3,967,872, issued Jul. 6, 1976, to Mooney et al.; 4,189,198, issued Feb. 19, 1980, to Reichman; 4,248,490, issued Feb. 3, 1981, to Bachle; and 4,806,108, issued Feb. 21, 1989, to Meinhardt are examples of grounding devices that require adapters for connecting the ground wire to the electrical cable coupler. U.S. Pat. Nos. 4,875,864, issued Oct. 24, 1989, to Campbell; and 5,315,063, issued May 24, 1994, to Auclair; Canadian Patent No. 968,431, issued May 27, 1975, to Thompson et al.; and U.K. Patent Document 2,224,893 A, to Dobson et al. published May 16, 1990, disclose typical grounding connectors that are wrapped, strapped, or tied to the electricity carrying conductor. U.S. Pat. Nos. 5,286,211, issued Feb. 15, 1994, to McIntosh; and 5,364,281, issued Nov. 15, 1994, to Leto; and U.K. Patent Document 2,232,020 A, to Kitagawa published Nov. 28, 1990, disclose specialty clamps for providing ground connections to electrical cables. U.S. Pat. Nos. 4,287,658, issued Mar. 24, 1981, to Hammond et al.; 4,739,126, issued Apr. 19, 1988 to Gutter et al.; and 5,418,330, issued May 23, 1995, to Rook disclose conventional ground terminations and connections.

None of the above inventions and patents, taken either singly or in combination, is seen to describe the instant invention as claimed.

SUMMARY OF THE INVENTION

As can be seen from the prior art, there is a need for a quick and efficient device for grounding/bonding a cable television signal supply cable without the added expense and complexity of jumper wires and couplers. The present invention contemplates various embodiments based on a planar block which confines both the cable television connector and the ground/bond wire. The planar block can have various configurations ranging from rectangular to polygonal with single or multiple cable television connector throughbores. A block containing one or more cable television connector throughbores can have a ground/bond wire throughbore for each connector. For a plurality of blocks having a plurality of cable television connectors aligned in a planar rectangular block, only two ground/bond wire throughbores are required, since any two blocks are connected by a ground/bond wire. The ground/bond wire can be attached to a grounding/bonding bolt instead of penetrating the block and being secured by a set screw. The cable television connector throughbore can have a uniform diameter or a larger diameter tapering to a smaller diameter depending on the existing connection. Either or both of the two-diameter bulk cable throughbores can be threaded or unthreaded depending on the existing connection. The single diameter throughbores can be threaded or unthreaded and secured with set screws depending on the existing connection. These configurations enable the efficient fabrication and connection of a cable television connector to a male F type connector and to a ground/bond connector in various environmental locations. The connections are made inside or outside the building either at the site of the electrical power meters or at more remote access boxes which are normally grounded.

Accordingly, it is a principal object of the invention to provide a device and a method for grounding/bonding an electrical cable.

It is another object of the invention to provide a device and a method for grounding/bonding electrical cable carrying cable television signals.

It is a further object of the invention to provide a device and a method for grounding/bonding cable television cables without jumper wires and couplers.

Still another object of the invention is to provide a cable television connector grounding/bonding device for multiple cables.

An additional object of the invention is to provide a cable television connector having an integral grounding/bonding device.

It is an object of the invention to provide improved elements and arrangements thereof in a device for the purposes described and a method for utilizing the device which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
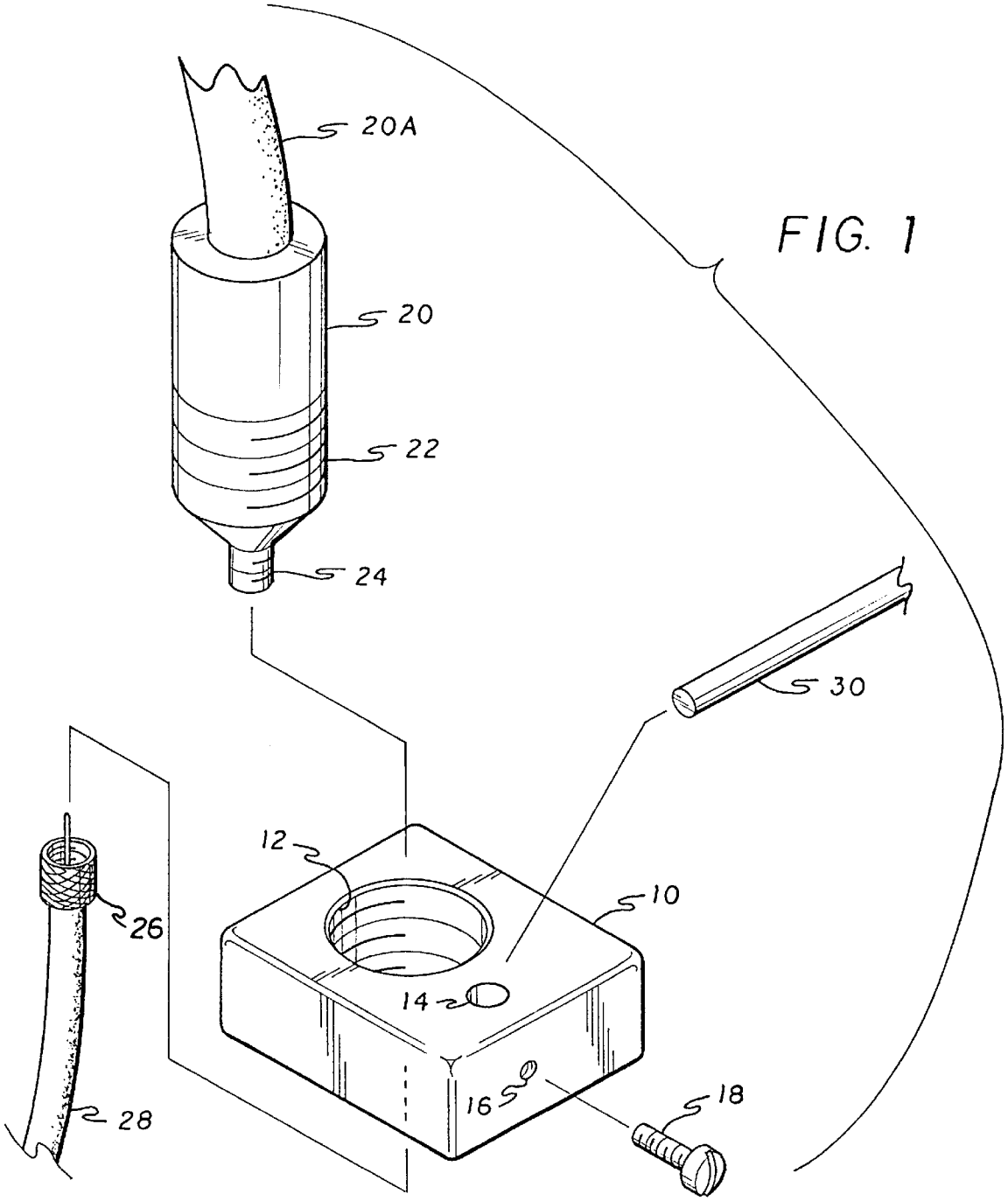
FIG. 1 is an exploded environmental perspective view of a first embodiment of the present invention.
Figure 7:
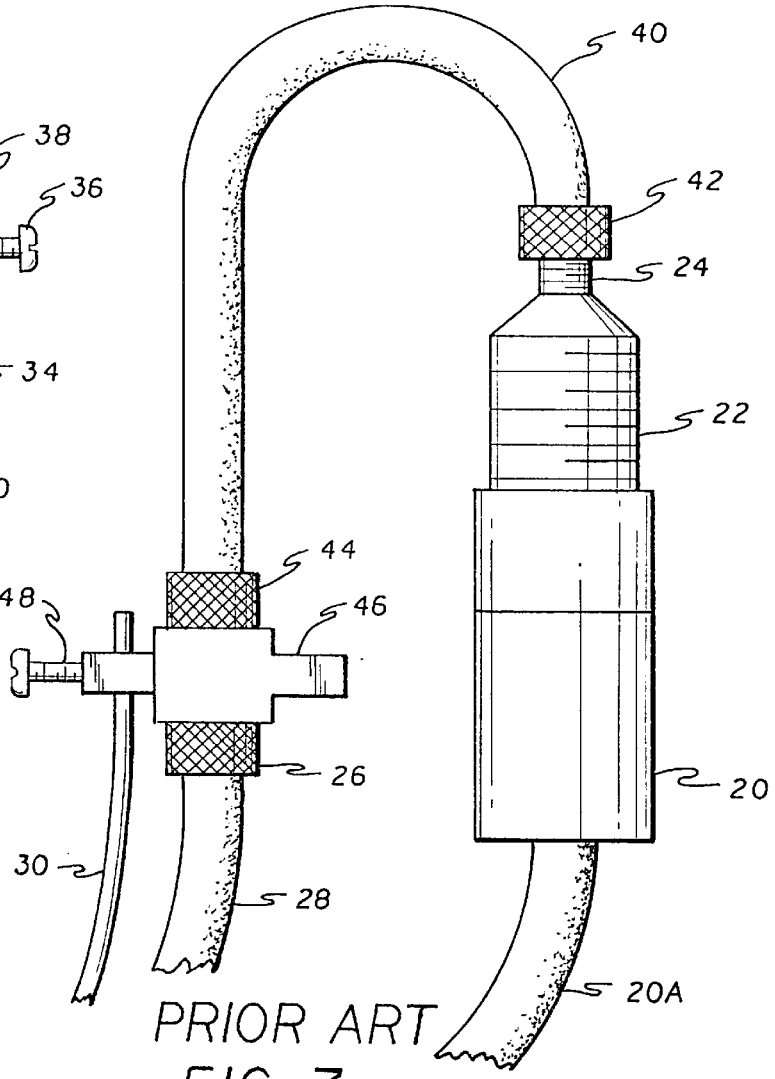
PRIOR ART FIG. 7
FIG. 7 is an elevational view, representative of a prior art grounding/bonding arrangement which requires a jumper cable and connector.

FIG. 1 as a first embodiment shows the present invention as it improves over the conventional standard cable television connector grounding scheme shown in FIG. 7 and described above. The cable television connector 20 is the termination of the main cable television service line 20A for delivering the RF cable television signal to a subscriber line 28. In the planar block 10, the cable television connector 20 has a first portion 22 and a second portion 24. These two portions have different diameters. The thinner second or end portion 24 provides a female F type connector for coupling with a corresponding male F type connector 26, thus supplying the RF cable television signal to the standard RG type cable (subscriber line) 28. The first thicker portion 22 is generally threaded and functions primarily as a point of mounting the cable television connector 20 to a bracket or harness type support (not shown). The present invention in all the embodiments secures the greater diameter portion 22 of the cable television connector 20 in the block.

It is noted that the National Electrical Code (N.E.C.) defines "grounded" as "circuits are grounded to limit excess voltages from lightning line surges, or unintentional contact with higher voltage lines and to limit the voltage to ground during normal operation", whereas "bonding" is defined in part as "assuring electrical continuity between non-current carrying parts". Therefore, these terms are recited alternatively, but within the above definitions.

Figure 2:
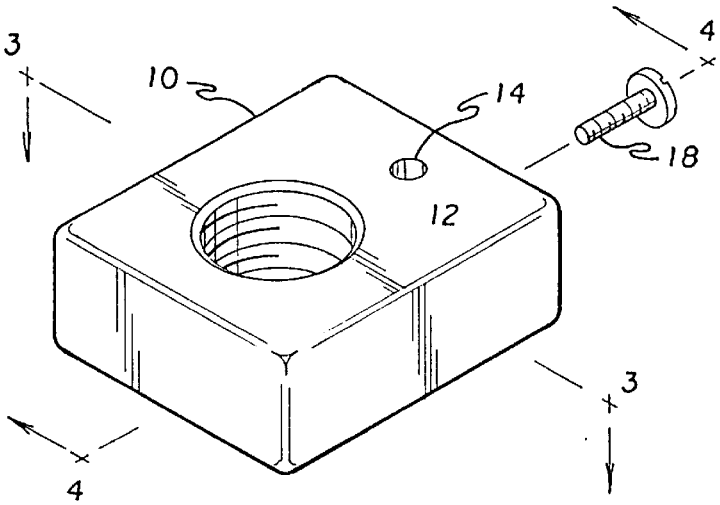
FIG. 2 is a perspective view of the grounding/bonding device of the first embodiment.
Figure 3:
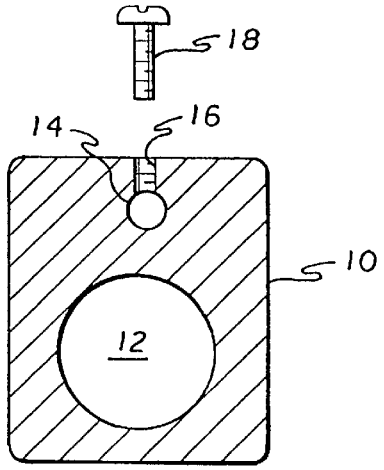
FIG. 3 is a cross-sectional view of the grounding/bonding device taken along line 3—3 of FIG. 2.
Figure 4:
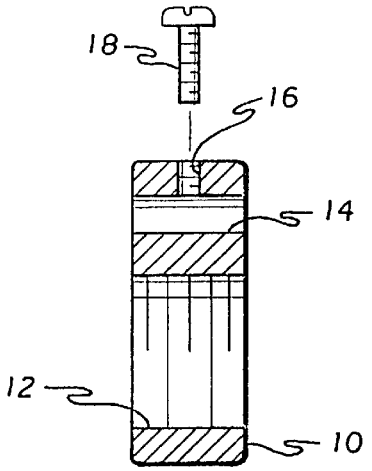
FIG. 4 is a cross-sectional view of the grounding/bonding device taken along line 4—4 of FIG. 2.

Referring to FIGS. 2–4, the block 10 is an electrically conductive material such as copper, brass, aluminum, iron, steel, and alloys thereof. In every embodiment, an aluminum alloy is the preferred material. Block 10 has a first throughbore 12 machined and tapped to accommodate the greater diameter portion 22 of the cable television connector 20. The throughbore 12 has threading matched to the threads of portion 22. Portion 22 is inserted until the block 10 is firmly seated in the connector 20. The seating of block 10 by connector 20 provides a durable electrical connection between the block 10 and the connector 20.

Block 10 has a second throughbore 14 formed therein for accommodating a solid copper wire 30 on the order of #8 American Wire Gage (AWG) as required by N.E.C. regulations, state and local ordinances and rules. A range of 14 to 8 AWG size copper wires are utilized in the invention. The wire 30 is conventionally used as a grounding/bonding conductor, i.e., it provides a direct path from an electricity carrying object to earth in order to reduce the risk of shock or injury to anyone due to an electrical overload or surge. The second throughbore 14, in the preferred embodiment, is a through-type opening. However, it is within the scope of the invention to provide a threaded or a grasping type surface in the block 10 within the second throughbore 14.

In a perpendicular communication with the second throughbore 14, block 10 has a third throughbore 16 which is machined and tapped. The third throughbore 16 accommodates a set screw 18 of conventional design with or without a head (not shown). The set screw 18 produces a locking engagement on the ground/bond wire 30 in the second throughbore 14. The locking engagement further produces an electrical connection between the block 10 and the wire 30, producing a direct path to ground/bonding point for the cable television connector. FIGS. 3 and 4 clearly show the cooperation of the throughbores 12, 14, and 16 through cross-sections, and one having ordinary skill in the art would understand the principles involved in establishing the electrical connections from the cable television connector 20 and ground via grounding/bonding wire 30.

Figure 5A:
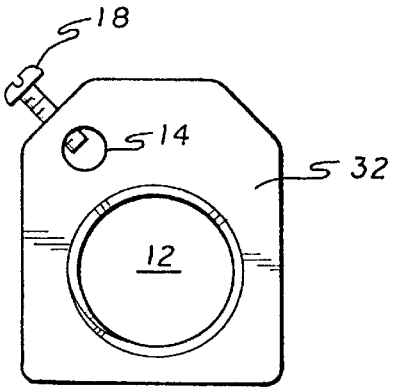
FIG. 5A is a plan view of a second embodiment of a grounding/bonding device of the present invention.
Figure 5B:
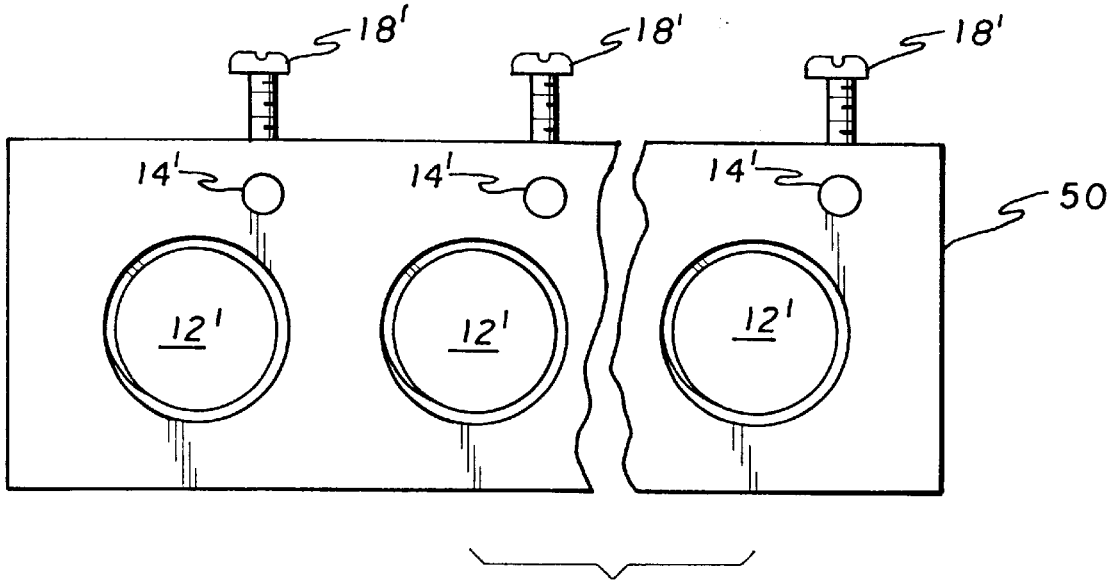
FIG. 5B is a plan view of a third embodiment of a grounding/bonding device of the present invention.
Figure 5C:
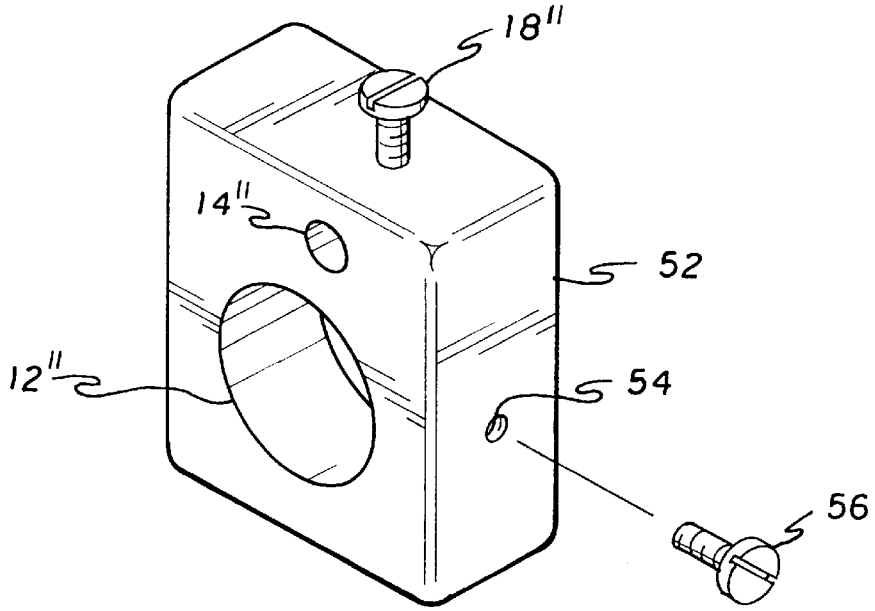
FIG. 5C is a perspective view of a fourth embodiment of a grounding/bonding device of the present invention.

FIGS. 5A, 5B, and 5C, are the second, third and fourth embodiments or alternative arrangements, respectively, for the cable television grounding/bonding device shown in FIGS. 1–4. FIG. 5A as a second embodiment illustrates that the shape of block 32, and the relative positions of throughbores 12, 14, and 16 (with set screw 18) can be altered in order to accommodate the environmental space requirements when the device of the present invention is installed.

FIG. 5B as a third embodiment illustrates a block 50, which is electrically equivalent to block 10; however, block 50 grounds/bonds multiple cable television connectors 20. Block 50 has multiple throughbores 12' for accommodating multiple cable television connectors 20. Throughbores 12' have the same structural and functional characteristics as the first throughbore 12 above. Also, block 50 has multiple throughbores 14' and multiple set screws 18' (which are inherently positioned in corresponding multiple throughbores 16', not shown). Likewise, the structural, functional, and electrical characteristics of throughbore 14', throughbore 16' and set screw 18' are the same as 14, 16 and 18 above. It is noted, however, that block 50 may only employ one grounding/bonding wire 30 in a throughbore 14' for providing the necessary earth connection.

FIG. 5C illustrates a fourth embodiment of the block 10 when the cable television connector 20 does not have annular threads on the greater diameter portion 22. In this example the block 52 has a throughbore 12" which slidingly seats the first unthreaded portion 22 of the cable television connector 20. Although, the sliding engagement may have enough frictional forces to maintain the structural and electrical connection, an additional fourth throughbore 54 is drilled and tapped into block 52. The fourth throughbore 54 is in perpendicular communication with the first throughbore 12". The second throughbore 14" accepts a ground/bond wire which is secured by set screw 18". The fourth throughbore 54 accepts a set screw 56 which serves the purpose and function, similar to set screws 18, 18', and 18", of producing a locking engagement between block 52 and the greater diameter portion 22 of the cable television connector 20. In addition, multiple fourth throughbores 54 with associated multiple set screws 56 could also be used in block 50 of FIG. 5B (not shown) without departing from the scope and spirit of the present invention.

Figure 6:
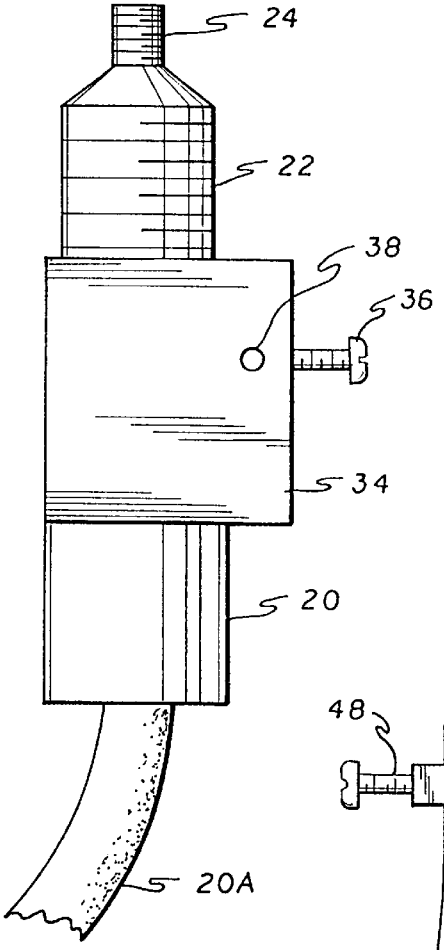
FIG. 6 is an enlarged scale elevational view of a fifth embodiment of a grounding/bonding device of the present invention.

FIG. 6 is a fifth embodiment of the present invention. The cable television connector 20 has a block 34 of electrically conductive material, a first threaded section 22 (and 34) and a second threaded section 24 integrally formed. In this embodiment, a fifth throughbore 38 is machined in the rectangular block 34 to accommodate a ground/bond wire 30. Also, a set screw 36 is provided in a drilled and tapped throughbore (not shown) to provide a locking engagement of the ground/bond wire 30 (not shown) to be inserted in the fifth throughbore 38 of block 34. It should be noted that in this embodiment the ground/bond wire 30 is positioned perpendicular to the cable television connector 20.

Figure 8:
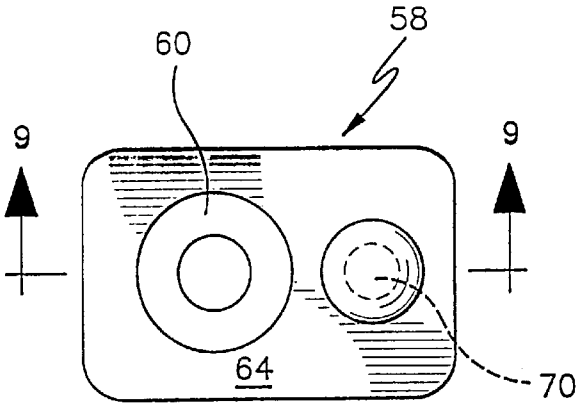
FIG. 8 is a plan view of a sixth embodiment of a grounding/bonding device of the present invention.
Figure 9:
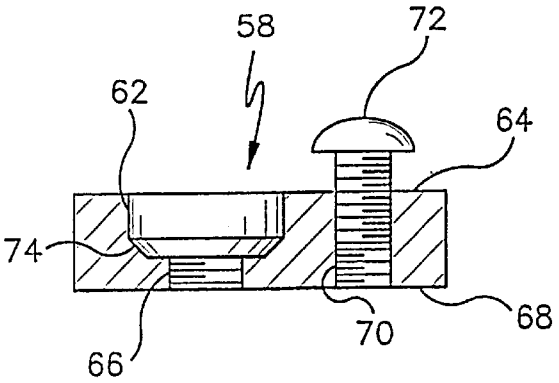
FIG. 9 is a cross-sectional view along line 9—9 of the grounding/bonding device of FIG. 8.

Turning to the sixth embodiment depicted in FIGS. 8 and 9, block 58 has a rectangular configuration with a throughbore 60 having a first large unthreaded diameter 62 at an upper surface 64 tapering to a threaded narrow diameter 66 at the bottom surface 68. A threaded throughbore 70 parallel to the throughbore 60 receives a grounding/bonding bolt 72 around which the ground/bonding wire (not shown) is fastened. The angled shoulder 74 in the throughbore 60 has no critical angle. The throughbore 60 is reamed at both ends (not shown) as are the throughbores which hold the cable television connector 20 in the remaining embodiments. For safety reasons, the block 58 and all subsequent embodiments include rounded corners and edges formed by deburring and finishing.

Figure 10:
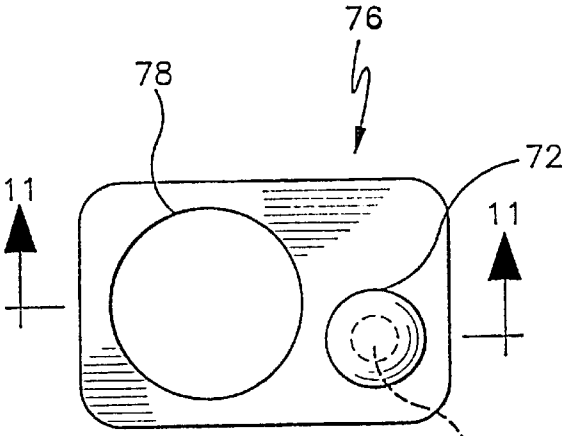
FIG. 10 is a plan view of a seventh embodiment of a grounding/bonding device of the present invention.
Figure 11:
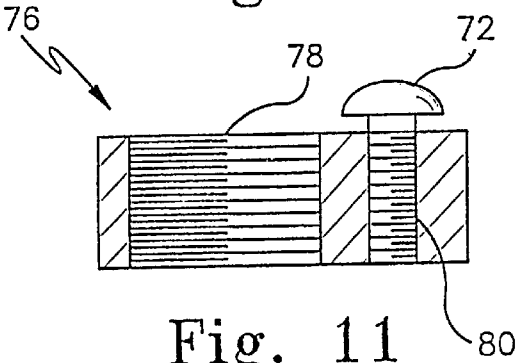
FIG. 11 is a cross-sectional view along line 11—11 of the grounding/bonding device of FIG. 10.

The seventh embodiment illustrated in FIGS. 10 and 11 shows a similar rectangular block 76, which includes a threaded throughbore 78 having a uniform diameter larger than the diameter of a threaded throughbore 80. As shown in FIG. 10, the threaded throughbores 80 is displaced from the midline of the block 76. Throughbore 78 receives and secures the threaded cable television connector 20, whereas throughbore 80 receives the grounding bolt 70. FIG. 11 is a sectional view along line 11—11 of FIG. 10.

Figure 12:
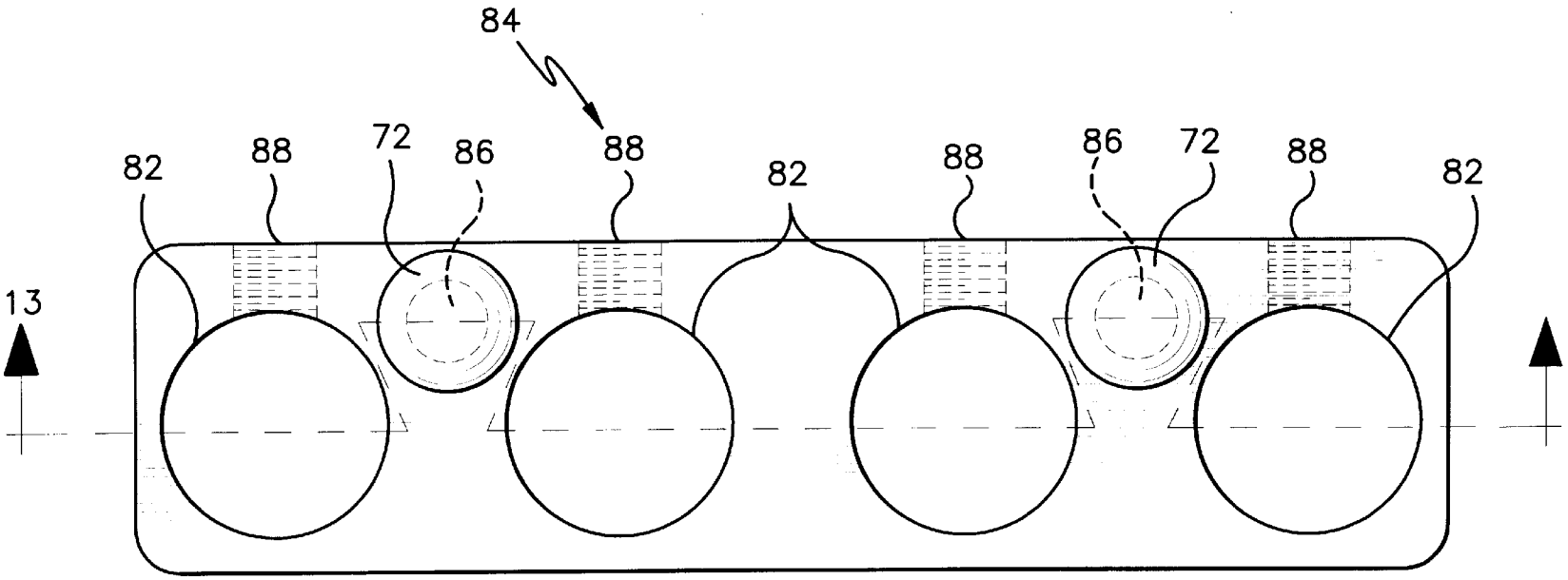
FIG. 12 is a plan view of an eighth embodiment of a grounding/bonding device of the present invention.
Figure 13:
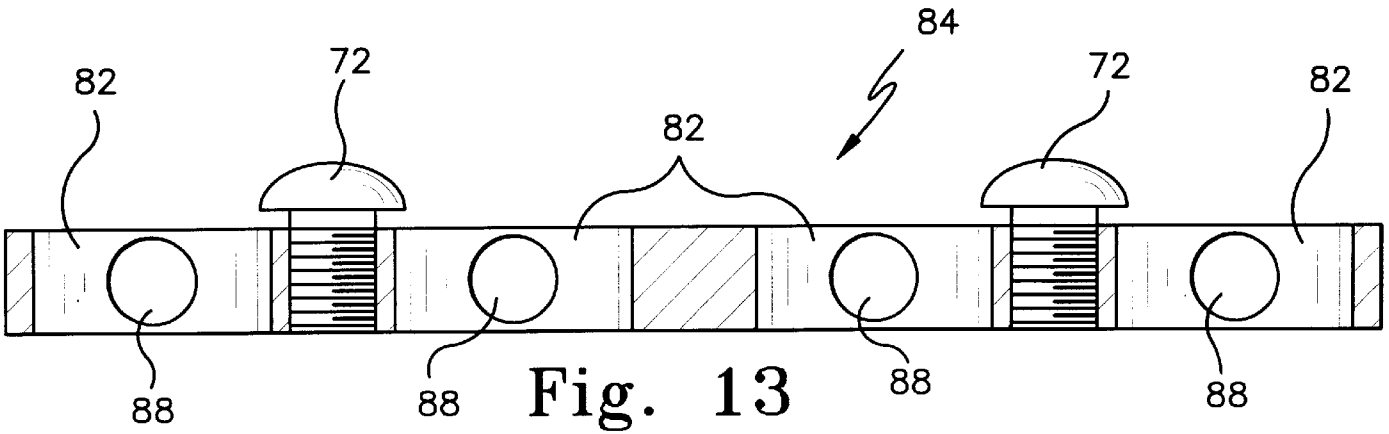
FIG. 13 is a cross-sectional view along line 13—13 of the grounding/bonding device of FIG. 12.

FIGS. 12 and 13 illustrate an eighth embodiment, which includes multiple (e.g., four), smooth sided throughbores 82 aligned in a row in the elongated rectangular block 84 for securing multiple cable television connectors 20 (not shown), and two threaded throughbores 86 for receiving the grounding/bonding bolts 72 that secure and electrically connect the ground/bond wire (not shown). FIG. 13 is a sectional view of the block 84 along line 13—13 of FIG. 12. FIG. 13 shows the median positions of four threaded throughbores 90 located on one side to secure the cable television connectors 20 with set screws (not shown). Blocks 84 can now be aggregated by coupling with ground/bond wire connectors (not shown) between adjacent blocks.

Figure 14:
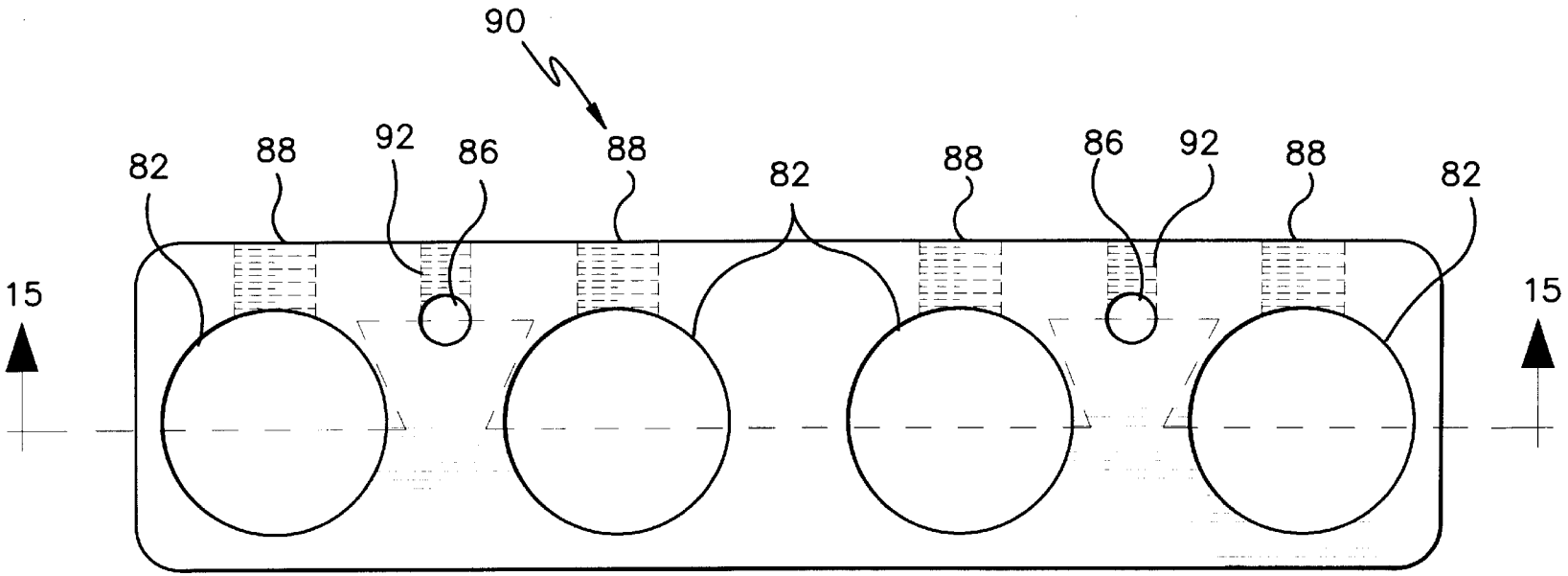
FIG. 14 is a plan view of a ninth embodiment of a grounding/bonding device of the present invention.
Figure 15:
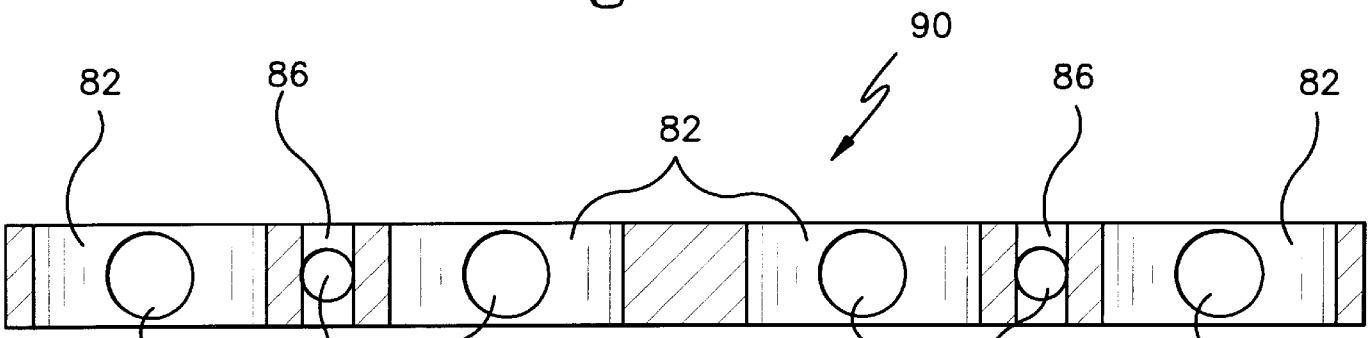
FIG. 15 is a cross-sectional view along line 15—15 of the grounding/bonding device of FIG. 14.

FIGS. 14 and 15 illustrate a ninth embodiment which is a variation of the eighth embodiment shown and described in connection with FIGS. 12 and 13. In block 90, throughbores 86 for receiving ground/bond wire (not shown) replace the grounding/bonding bolts 72 of FIGS. 12 and 13. Set screws (not shown) are inserted in each of the two smaller threaded throughbores 92, which communicate with respective throughbores 86 in perpendicular relation thereto, for securing the ground/bond wires. FIG. 15 is a sectional view taken along line 15—15 of the block 90 of FIG. 14.

Figure 16:
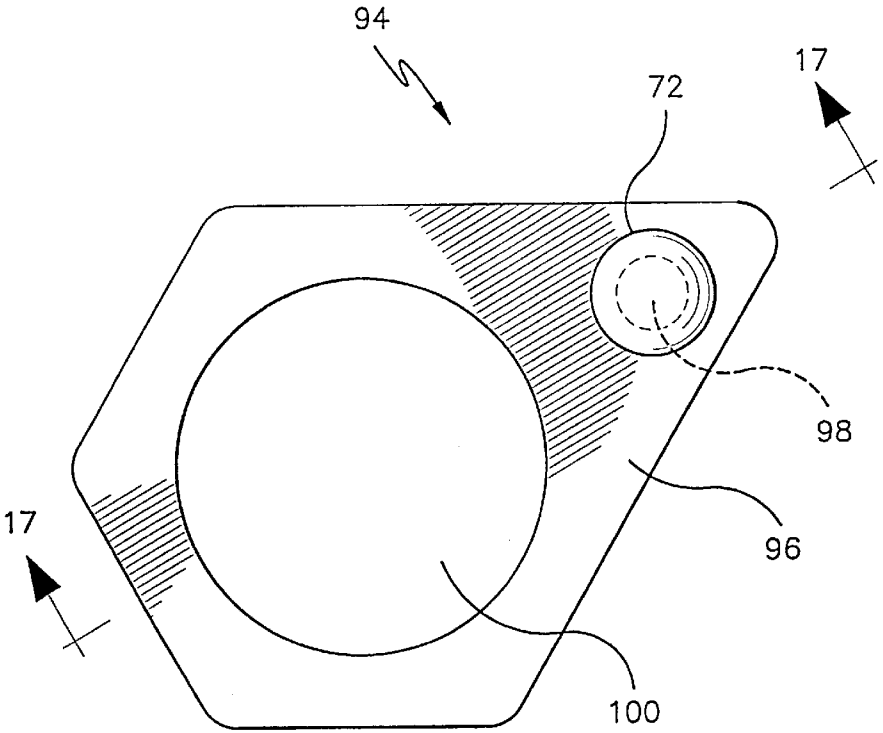
FIG. 16 is a plan view of a tenth embodiment of a grounding/bonding device of the present invention.
Figure 17:
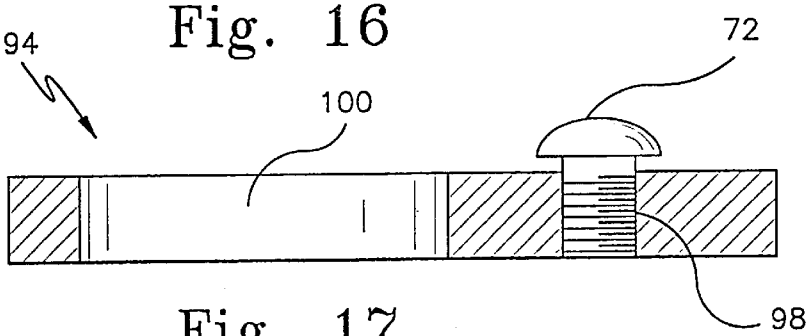
FIG. 17 is a cross-sectional view along line 17—17 of the grounding/bonding device of FIG. 16.

FIGS. 16 and 17 depict a tenth embodiment having a unique configuration, wherein the block 94 has a polygonal shape with five sides. One side is extended in a triangular appendage 96 containing a threaded throughbore 98 for securing the grounding/bonding bolt 72. The unthreaded throughbore 100 which is centered in the opposite portion secures the cable television connector (not shown) by either friction fitting or by a set screw from a side (not shown). The polygonal shape saves expensive material by having a tapered appendage 96. This embodiment can be further modified to accept a cable television connector having a triangular or square cross-section by modifying the shape of throughbore 100.

While the invention has been illustrated and described in detail in the drawings and foregoing description, the same is to be considered as illustrative and not restrictive in character and scope. For example, the device can be used for providing grounding/bonding connections for many other types of electricity carrying devices, such as water or gas lines which are subject to induced currents or lightning strikes. While the present invention has been described with respect to cylindrical cable television connectors, it should be apparent that the present invention could equally and readily be adapted to accommodate other types of connectors having differently shaped cross-sections (such as square or triangular, etc.) by virtue of the alternative arrangement shown in FIGS. 5C, 8, 9, and 12–17.

It is to be understood that the present invention is not limited to the sole embodiments described above, but encompasses any and all embodiments within the scone of the following claims.

We claim:

1. A device for grounding or electrically bonding a cable television connector and eliminating a jumper wire connection, comprising:

a television cable connector having a threaded large diameter portion tapering to a threaded small diameter end portion;

a block of electrically conductive material;

a ground/bond wire having an earthed end and a free end; and a threaded ground/bond wire fastener;

said block having at least two throughbores of different diameters in parallel alignment therein;

a first throughbore of said at least two throughbores being larger in diameter to receive and hold said threaded television cable connector; and a second throughbore of said at least two throughbores being smaller in diameter to receive and hold said ground/bond wire fastener;

whereby a jumper cable connection is eliminated by said cable television connector being threaded into said first throughbore and said ground/bond wire fastener being threaded into said second throughbore to secure said free end of said ground/bond wire.

2. The device according to claim 1, wherein said fastener is a bolt around which the free end of the ground/bond wire can be secured.

3. The device according to claim 2, including annular threads in said first throughbore for securing said television cable connector.

4. The device according to claim 3, wherein said first throughbore is misaligned with said second throughbore, whereby maximum use of available space in the block is obtained.

5. The device according to claim 1, wherein said first throughbore has a smooth large diameter portion tapering to a threaded smaller diameter portion.

6. The device according to claim 1, wherein the first throughbore having a smooth wall is centered in a polygonal shaped block having an appendage extending from one facet and ending in a rounded point, said appendage containing said second throughbore which is threaded to receive a bolt as said ground/bond fastener.

7. The device according to claim 1, further including said block being rectangular and having four aligned unthreaded first throughbores and two aligned second throughbores, wherein each second throughbore is located proximate to an end of said rectangular block and between two first throughbores.

8. The device according to claim 7, wherein threaded third throughbores communicate axially and perpendicularly with each said first throughbore to secure each threaded cable television connector with a set screw inserted therein as a threaded cable fastener.

9. The device according to claim 7, wherein the number of said second throughbores is one-half the number of said first throughbores.

10. The device according to claim 7, wherein at least two of said blocks are combined by connection of a grounding/bonding wire between two adjacent blocks.

11. The device according to claim 7, wherein said second throughbores are smooth-walled and communicate with threaded throughbores which are axially and perpendicular to said second throughbores to receive set screws as fasteners which secure each ground/bond wire.

12. A device for grounding/bonding a cable television connector and eliminating a jumper wire connection, comprising:

a cable television connector having a threaded large diameter portion tapering to a threaded small diameter end portion;

a planar rectangular block of electrically conductive material;

a ground/bond wire having an earthed end and a free end; and a ground/bond wire fastener selected from a set screw and a bolt;

said block having means defining a plurality of at least three throughbores therein;

a first of said at least three throughbores dimensioned to receive and hold said threaded cable television connector;

a second of said at least three throughbores dimensioned to receive said free end of the ground/bond wire; and a third of said at least three throughbores communicating axially and perpendicularly with said second throughbore, and being dimensioned to threadably receive said ground/wire wire fastener;

whereby a jumper cable connection is eliminated by said cable television connector being threaded into said first throughbore and said ground/bond wire fastener being inserted in said second throughbore to secure said free end of said ground/bond wire by said fastener.

13. The device according to claim 12, further including the integration of said block and said cable television connector as one unit.

14. The device according to claim 12, including two adjacent corners of said planar block being flattened, wherein one flattened corner has said second and third throughbores for securing the ground/bond wire with a set screw.

15. The device according to claim 12, including a fourth throughbore in said block and another set screw, said fourth throughbore communicating axially and perpendicularly with said first throughbore and threadably receiving said another set screw, wherein said another set screw is turned in said fourth throughbore for securing the cable television connector in said block.

16. The device according to claim 12, said block being elongate and having a plurality of the first, second and third throughbores in alignment, each of said plurality of first throughbores being capable of receiving and holding a separate threaded cable television connector, each of said plurality of second throughbores being capable of receiving a separate ground/bond wire fastener, and each of said plurality of third throughbores being capable of receiving said free end of a separate length of said ground/bond wire;

whereby a plurality of cable television connectors are grounded/bonded.

17. The device according to claim 16, including annular threads in each said first throughbore of said plurality of said three throughbores for threadably receiving the cable television connectors.

18. A method for grounding/bonding a cable television connector and eliminating a jumper wire connection comprising:

providing a cable television connector having a threaded large diameter portion tapering to a threaded small diameter end portion;

providing a planar block of electrically conductive material;

providing a ground/bond wire having an earthed end and a free end; and providing a ground/bond wire fastener selected from a set screw and a bolt;

the block having a plurality of at least two throughbores therein;

inserting the threaded cable television connector into a first of the at least two throughbores and creating an electrical connection; and inserting the ground/bond wire fastener into a second of the at least two throughbores and creating an electrical connection;

whereby a jumper cable connection is eliminated by the cable television connector being threaded into the first throughbore, and the ground/bond wire fastener being inserted in the second throughbore to secure the free end of the ground/bond wire.

19. A method of grounding/bonding a cable television connector and eliminating a jumper wire connection comprising:

providing a cable television connector having a threaded large diameter portion tapering to a threaded small diameter end portion;

providing a planar rectangular block of electrically conductive material;

providing a ground/bond wire having an earthed end and a free end; and providing a ground/bond wire fastener selected from a set screw and a bolt;

the block having a plurality of at least three throughbores therein;

inserting the threaded cable television connector into a first of the at least two throughbores and creating an electrical connection; and inserting the ground/bond wire fastener into a second of the at least two throughbores; and inserting the free end of the ground/bond wire into a third of the at least three throughbores, the third throughbore communicating perpendicularly with the second throughbore, the ground/bond wire fastener contacting the free end of the ground wire and creating an electrical connection with the fastener;

whereby a jumper cable connection is eliminated by said cable television connector being threaded into the first throughbore and the ground/bond wire fastener being inserted in the second throughbore to secure the free end of the ground/bond wire by the fastener.

20. The method according to claim 19, the block having a plurality of the first, second and third throughbores in alignment, each of the plurality of first throughbores being capable of receiving and holding a separate threaded cable television connector, each of the plurality of second throughbores being capable of receiving a separate ground/bond wire fastener, and each of the plurality of third throughbores being capable of receiving the free end of a separate length of the ground/bond wire;

whereby a plurality of cable television connectors are grounded/bonded.

* * * * *